US008770207B2

(12) United States Patent
Takagi

(10) Patent No.: US 8,770,207 B2
(45) Date of Patent: Jul. 8, 2014

(54) APPLICATOR AND PARTIAL HAIR DYEING DEVICE

(75) Inventor: Yoshimasa Takagi, Tokyo (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 13/508,667

(22) PCT Filed: Nov. 10, 2010

(86) PCT No.: PCT/JP2010/006590

§ 371 (c)(1),
(2), (4) Date: May 8, 2012

(87) PCT Pub. No.: WO2011/058739

PCT Pub. Date: May 19, 2011

(65) Prior Publication Data

US 2012/0222693 A1 Sep. 6, 2012

(30) Foreign Application Priority Data

Nov. 11, 2009 (JP) ..... 2009-257805

(51) Int. Cl.

| | |
|---|---|
| ***A45D 24/22*** | (2006.01) |
| ***A45D 19/18*** | (2006.01) |
| ***A46B 11/00*** | (2006.01) |
| ***A45D 19/02*** | (2006.01) |
| *A45D 19/00* | (2006.01) |

(52) U.S. Cl.

CPC ..... *A45D 19/02* (2013.01); *A45D 2019/0066* (2013.01)

USPC ..... 132/112; 132/270; 401/10

(58) Field of Classification Search

CPC ... A45D 19/02; A45D 19/18; A45D 19/0008; A45D 2019/0066; A45D 2019/0083; A45D 2019/0091

USPC ..... 132/270, 200, 207, 210, 212, 108–113, 132/221, 272, 320, 131, 223, 138, 142, 224, 132/208, 228, 150, 114; 401/9, 207, 196, 401/203, 10, 261, 11, 128, 130, 138, 139, 401/140, 184, 185, 186, 122, 127, 262; 15/107, 209.1, 210.1; 222/92; 118/263, 118/264, 265; 8/405, 478, 486

See application file for complete search history.

(56) References Cited

U.S. PATENT DOCUMENTS

| | | | | |
|---|---|---|---|---|
| 2,761,459 A * | 9/1956 | Kaul | ..... | 132/109 |
| 2,776,667 A * | 1/1957 | Fitzgerald | ..... | 132/224 |

(Continued)

FOREIGN PATENT DOCUMENTS

| | | |
|---|---|---|
| JP | 57-52405 | 3/1982 |
| JP | 10-290712 | 11/1998 |

(Continued)

OTHER PUBLICATIONS

English Translation of the Written Opinion of the International Searching Authority issued Jan. 18, 2011, in PCT/JP2010/006590.

(Continued)

*Primary Examiner* — Vanitha Elgart

(74) *Attorney, Agent, or Firm* — Oblon, Spivak, McClelland, Maier & Neustadt, L.L.P.

(57) ABSTRACT

An applicator (100) for applying a treatment agent to one's hair includes a container connector (110) for connection with a dispensing container (ST) accommodating therein the treatment agent, an upper guide member (120) formed in a hollow shape so as to extend forward from the container connector (110) and including an outlet formed in a lower face for dispensing the treatment agent, a lower guide member (130) disposed parallel to the upper guide member so as to oppose the outlet, and a parallel supporting body (140) that displaces at least one of the upper guide member (120) and the lower guide member (130) up and downward, while maintaining the guide members parallel to each other. With the applicator (100) an individual user can easily apply the treatment agent uniformly to the hair.

15 Claims, 10 Drawing Sheets

(56) References Cited

U.S. PATENT DOCUMENTS

| | | | | |
|---|---|---|---|---|
| 3,424,176 | A * | 1/1969 | Hale | 132/112 |
| 3,450,140 | A * | 6/1969 | Vail | 132/212 |
| 3,603,323 | A * | 9/1971 | Avella | 132/131 |
| 3,861,405 | A * | 1/1975 | Pellecchia | 132/270 |
| 3,921,647 | A * | 11/1975 | Fisher | 132/270 |
| 4,385,638 | A | 5/1983 | Hasegawa | |
| 5,059,050 | A * | 10/1991 | Guglielmo | 401/171 |
| 5,060,679 | A * | 10/1991 | Christopher et al. | 132/114 |
| 5,755,241 | A * | 5/1998 | Cheung | 132/112 |
| 6,295,993 | B1 * | 10/2001 | Ouellette | 132/208 |
| 6,615,847 | B1 * | 9/2003 | Hagelstam | 132/225 |
| 6,748,957 | B1 * | 6/2004 | Giordano | 132/112 |
| 7,156,885 | B2 * | 1/2007 | Kennedy et al. | 8/405 |
| 7,425,220 | B2 * | 9/2008 | Barrass et al. | 8/405 |
| 2003/0131864 | A1 * | 7/2003 | Lu | 132/108 |
| 2005/0166938 | A1 * | 8/2005 | Hoepfl et al. | 132/200 |
| 2007/0144550 | A1 * | 6/2007 | Roher | 132/208 |
| 2008/0156339 | A1 * | 7/2008 | Moosmann | 132/116 |
| 2008/0223386 | A1 * | 9/2008 | Albisetti | 132/112 |
| 2008/0283079 | A1 * | 11/2008 | Huang | 132/221 |
| 2009/0101159 | A1 * | 4/2009 | Bonnafous et al. | 132/112 |
| 2010/0037910 | A1 * | 2/2010 | Muller-Grunow et al. | 132/208 |
| 2010/0192971 | A1 * | 8/2010 | Sabato | 132/221 |
| 2010/0242986 | A1 * | 9/2010 | Serresvives et al. | 132/227 |
| 2011/0005546 | A1 * | 1/2011 | Muller-Grunow et al. | 132/270 |
| 2011/0265808 | A1 * | 11/2011 | Conn | 132/200 |
| 2012/0017930 | A1 * | 1/2012 | Nance | 132/208 |

FOREIGN PATENT DOCUMENTS

| | | |
|---|---|---|
| JP | 2002-34636 | 2/2002 |
| JP | 2002-165630 | 6/2002 |
| JP | 2002-186515 | 7/2002 |
| WO | WO 2004/057997 A2 | 7/2004 |
| WO | WO 2007/025918 A2 | 3/2007 |

OTHER PUBLICATIONS

International Search Report issued Jan. 18, 2011, in PCT/JP2010/006590.

Extended European Search Report mailed Jan. 28, 2014, in European Patent Application No. 10829703.7.

* cited by examiner

APPLICATOR AND PARTIAL HAIR DYEING DEVICE

TECHNICAL FIELD

The present invention relates to an applicator for applying a treatment agent to one's head hair, and a partial hair dyeing device utilized for partially dyeing the hair.

BACKGROUND ART

Nowadays, it is a common practice to apply various kinds of treatment agents to one's hair, for example dyeing the hair to achieve a higher visual effect, and various devices for such application have been developed. Regarding the hair dyeing, for example, in the case of uniformly dyeing the entire hair, so called whole dyeing, it is not necessary to select a specific portion of the hair to be dyed, and the hair dye may simply be applied to the entirety of the hair. Accordingly, the dyeing work is relatively easy.

However, in the case of selectively dyeing a part of the hair, so called partial dyeing, the work is rather complicated. For example, in hair salons, the portion of the hair to be partially dyed is extracted in a layer from the head with a tapered tail portion of a comb called "tail comb", and the hair dye is applied to the extracted hair with a brush.

Here, the expression "extract the hair in a layer" means that a group of hair is selectively drawn out from the head so that the group of hair forms a thin plane of a generally uniform thickness, and practical methods are shown, for example, in FIG. 17 of the patent document 1 and FIG. 3 of the patent document 2.

The partial dyeing may be performed for inner hair close to the scalp. By selectively dyeing the inner hair close to the scalp in addition to outer hair, the dyed inner hair becomes visible through the outer hair and thus a natural appearance can be achieved.

However, it is difficult for an individual user to practice such a technique as performed in hair salons. Accordingly, devices to be used by individual users exclusively for practicing the partial dyeing have been developed.

An example of the partial hair dyeing devices is formed as a nozzle member to be attached to a dispensing outlet of a container loaded with hair dye. The nozzle member includes an open groove at the tip portion thereof, so that the hair of the portion to be partially dyed can be passed through the groove. To perform the partial dyeing, the hair to be partially dyed is gathered in a bundle and passed through the open groove of the nozzle member attached to the container.

The user brings the nozzle member to the base portion of the hair, and moves the nozzle member from the base portion to the tip portion of the hair to be partially dyed, while keeping the container pressed. During this action the hair dye is dispensed to the open groove of the nozzle member, so that the hair of the desired portion can be partially dyed (for example, see patent document 1).

Another example of the partial hair dyeing devices includes a comb body, a hair grasp member pivotally attached to a base portion of the comb body, and a container loaded with hair dye. In this partial hair dyeing device the hair grasp member includes a pinching portion and an operating portion. The pinching portion is formed in a frame shape so as to surround the respective sides of the comb teeth in a pinching action, and the operating portion includes a finger-hook portion extending along the pivoting plane of the hair grasp member (for example, see patent document 2).

RELATED DOCUMENTS

Patent Documents

[Patent document 1] Japanese Laid-Open Patent No. H10-290712

[Patent document 2] Japanese Laid-Open Patent No. 2002-165630

DISCLOSURE OF THE INVENTION

Problem to be Solved by the Invention

With the partial hair dyeing device according to the patent document 1, however, the hair to be partially dyed is passed through the open groove of the nozzle member in a bundle, and therefore the hair dye is prone to be unevenly applied. This is because, as described in the paragraph 0022 of the patent document 1 with reference to FIG. 8, the bundle of hair is pressed by the bottom portion of the open groove so as to be gradually formed into a roundish column shape, and resultantly it becomes difficult to effectively apply the hair dye to the hair in an inner portion of the bundle, compared with the hair of an outer portion of the bundle.

In addition, in the hair dyeing device according to the patent document 2 the comb body and the pinching portion are pivotally coupled in a form of scissors, so as to catch the hair by widely opening the comb body and the pinching portion. Accordingly, when one attempts to selectively extract the inner hair close to the scalp in a layer from the head, since the comb body and the pinching portion are widely open the entirety of the hair located on the pinching portion is caught.

Therefore, in order to selectively extract the inner hair close to the scalp in a layer from the head, so as to partially dye only the extracted hair with comb body and the pinching portion according to the patent document 2, the hair located in an outer portion of the hair to be partially dyed has to be separated in advance with a tail comb or the like.

Consequently, it is difficult to grasp the hair in a layer of a uniform thickness with the device according to the patent document 2 for partial dyeing the hair, and therefore the device is difficult to use, especially for an individual user, to perform the partial dyeing by oneself.

As described above, it is difficult to apply a treatment such as hair dye to the hair of a desired portion accurately by using the conventionally available devices. The present invention has been accomplished in view of the foregoing problem, and provides an applicator that enables an individual user to easily and uniformly apply, by him/herself, a treatment agent to his/her head hair, and a partial hair dyeing device that enables the user to partially dye his/her hair easily in uniform layers.

Solution to Problem

Accordingly, the present invention provides an applicator to be used for applying a treatment agent to one's head hair, including a container connector for connection with a dispensing container accommodating therein the treatment agent; an upper guide member of a hollow shape including an outlet formed in a lower face thereof through which the treatment agent is dispensed, and formed so as to extend forward from the container connector; a lower guide member disposed parallel to the upper guide member so as to oppose the outlet;

and a parallel supporting body that displaces at least one of the upper guide member and the lower guide member up and downward, while maintaining the upper guide member and the lower guide member parallel to each other.

With the applicator according to the present invention, the treatment agent is dispensed through the outlet, so as to be applied through the hollow upper guide member to the hair introduced in a layer between the upper guide member and the lower guide member parallel to each other. Then the treatment agent can be uniformly applied to the hair by moving the upper guide member and the lower guide member holding the hair therebetween in a longitudinal direction of the hair.

The present invention also provides a partial hair dyeing device to be used for partially dyeing one's head hair, including a container connector for connection with a dispensing container accommodating hair dye therein; an upper grasp member of a hollow shape formed in a slender shape extending forward from the container connector, and including an outlet through which the hair dye is dispensed, the outlet being located on a lower face of the upper grasp member; a lower grasp member formed in a slender shape and disposed parallel to the upper grasp member so as to oppose the outlet; and a parallel supporting body that displaces at least one of the upper grasp member and the lower grasp member up and downward, while maintaining the upper grasp member and the lower grasp member parallel to each other.

In the partial hair dyeing device according to the present invention, the dispensing container loaded with the hair dye is connected to the rear portion of the container connector. The hair dye can be dispensed from the upper grasp member of a hollow shape formed in a slender shape extending forward from the container connector, through the outlet formed in the lower face of the upper grasp member. The lower grasp member is formed in a slender shape and disposed parallel to the upper grasp member so as to oppose the outlet. The parallel supporting body maintains the upper grasp member and the lower grasp member thus configured parallel to each other, and displaces at least one of them up and downward. Accordingly, the upper grasp member and the lower grasp member, which move close to and away from each other remaining parallel to each other, can grasp the base portion of the hair to be partially dyed in a uniform layer. When the dispensing container is pressed with the hair grasped as above, the hair dye is dispensed through the outlet of the upper grasp member, so that the base portion of the grasped hair can be dyed. Then by moving the partial hair dyeing device to the tip portion of the hair with the dispensing container kept pressed, the hair can be partially dyed in a uniform layer.

It is to be noted that the constituents of the present invention do not have to be individually independent, but may be arranged as the case may be, such that a plurality of constituents composes a single member; a constituent is composed of a plurality of members; a constituent constitutes a part of another constituent; a part of a constituent and a part of another overlap; and so forth.

Further, although forward and backward, left and right, and up and downward directions are specified in the present invention, such expressions are adopted merely for convenience sake for clearer description of the positional relationship between the constituents of the present invention, and in no way limit the direction in practical application of the present invention or in the manufacturing process. In addition, the expression of the direction of a given portion only applies to that portion, and therefore, for example, a forward direction of a portion and a forward direction of another portion may refer to different directions.

The term "hair dyeing" according to the present invention refers to changing the apparent color of the hair, and broadly includes hair manicuring that employs a coloring hair dye so as to put a color on the hair, hair coloring that employs an oxidation hair dye or the like to perform both color removal and coloring of the hair, and bleaching that employs a decoloring agent or destainer so as to remove the color from the hair. The term "partial dyeing" according to the present invention refers to dyeing at least a part of hair in the longitudinal direction thereof, with respect to a portion of hair out of the multitude number of hair growing from the scalp. In addition, a method of dyeing hair divided into narrow streaks, so called streak dyeing, is also included in the scope of the partial dyeing according to the present invention. Naturally, applying the partial dyeing to the entirety of the hair results in completion of whole hair dyeing with the hair dye.

Effects of the Invention

The applicator and the partial hair dyeing device according to the present invention allows a treatment agent to be uniformly applied to hair introduced in a layer between an upper guide member and a lower guide member disposed parallel to each other. In particular, the treatment agent can be selectively applied to inner hair close to the scalp.

BRIEF DESCRIPTION OF THE DRAWINGS

The above and other objects, features, and advantages will become more apparent through the following description of preferred embodiments and the accompanying drawings.

DESCRIPTION OF EMBODIMENTS

Figure 1A:
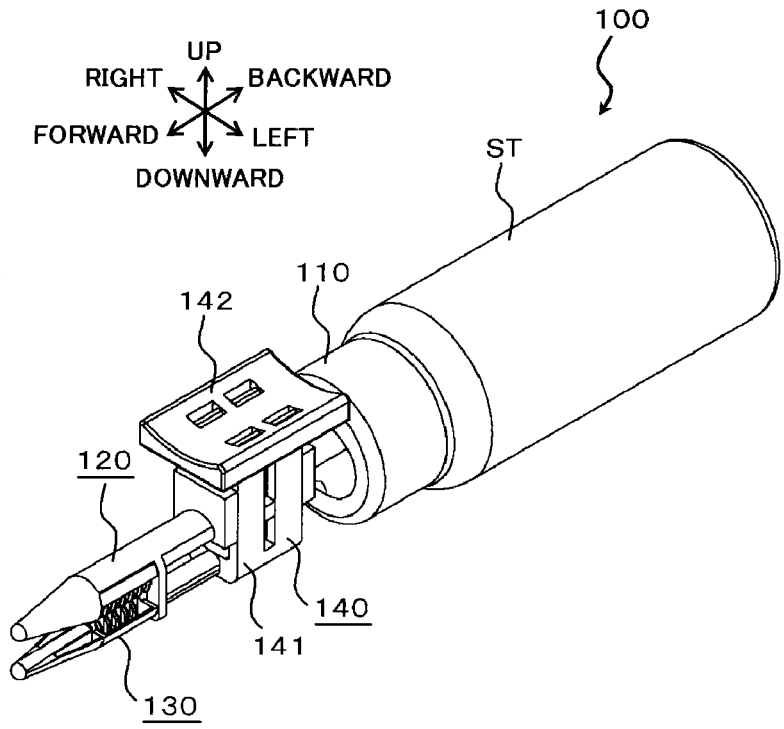
FIGS. 1A and 1B are perspective views showing an appearance of a partial hair dyeing device according to an embodiment of the present invention, FIG. 1A showing an upper guide member (upper grasp member according to the embodiment) and a lower guide member (lower grasp member according to the embodiment) in an opened state, and FIG. 1B showing the upper grasp member and the lower grasp member in a closed state.

Hereafter, an embodiment of the present invention will be described referring to FIGS. 1A to 8B. Although forward and backward, left and right, and up and downward directions are specified in the embodiment, such expressions are adopted merely for convenience sake for clearer description of the positional relationship between the constituents of the present invention, and in no way limit the direction in practical application of the present invention or in the manufacturing process.

An applicator (partial hair dyeing device 100) according to this embodiment is to be employed for applying a treatment agent to one's hair HI. The applicator (partial hair dyeing device 100) includes a container connector 110, an upper guide member (upper grasp member 120), a lower guide member (lower grasp member 130), and a parallel supporting body 140.

The container connector 110 is a component to which a dispensing container ST loaded with the treatment agent is connected.

The upper guide member (upper grasp member 120) has a hollow shape including an outlet 121 formed on a lower face thereof so as to dispense the treatment agent therethrough, and is formed so as to extend forward from the container connector 110.

The lower guide member (lower grasp member 130) is disposed parallel to the upper guide member (upper grasp member 120) so as to oppose the outlet 121.

The parallel supporting body 140 displaces at least one of the upper guide member (upper grasp member 120) and the lower guide member (lower grasp member 130) up and downward, while maintaining the upper guide member and the lower guide member so as to oppose each other in parallel.

The treatment agent can be exemplified by a liquid or a gel that changes the apparent color of the hair, such as a hair dye, a surface lustering agent, a color fixing agent, a decoloring agent, and a destainer. Additional examples of the treatment agent include those that change the characteristic of the hair, such as a hair softener, a hair elasticizer, a hair straightening agent, and a hair waving agent.

The dispensing container ST accommodates therein the treatment agent (exemplified by the hair dye in this embodiment) when the partial hair dyeing device 100 according to this embodiment is put to use. The dispensing container ST does not have to contain the treatment agent in the manufacturing process and distribution system of the partial hair dyeing device 100.

The upper guide member and the lower guide member serve to introduce the hair HI therebetween, and to thinly distribute the hair HI in a layer. The upper guide member and the lower guide member are configured so as to move close to or away from each other in parallel, i.e., remaining parallel or generally parallel to each other. The shape of the upper guide member and the lower guide member is not specifically limited, and may be a slender shape extending toward the leading end portion (forward) from the container connector 110, of a wide shape which is wider than long. The upper guide member and the lower guide member may each be of a straight shape or a curved shape. Further, when the upper guide member and the lower guide member come close to each other so as to grasp the hair HI introduced therebetween, the both members may be in contact with the hair HI, or at least either one may be out of contact with the hair HI. Hereunder, the upper grasp member 120 and the lower grasp member 130 exemplifying the upper guide member and the lower guide member, configured so as to retain the hair HI introduced therebetween by pinching the hair HI from upper and lower directions to thereby apply the treatment agent, will be described as the embodiment of the present invention.

For the purpose of description, the component that includes the outlet 121 of the treatment agent will be called as upper guide member. In addition, the direction of the lower guide member (lower grasp member 130) viewed from the upper guide member (upper grasp member 120) will be referred to as downward. However, the orientation of the partial hair dyeing device 100 in the manufacturing process or in use is arbitrary, and it is not mandatory that the upper guide member is located above the lower guide member in the gravity direction.

The upper grasp member is formed in a hollow shape. An end portion of the hollow portion communicates with the outlet 121, and the other end portion communicates with the dispensing container ST when the partial hair dyeing device 100 is put to use. The treatment agent is supplied through the hollow portion, from the dispensing container ST to the outlet 121.

Specifically, the partial hair dyeing device 100 according to this embodiment is to be used for partially dyeing the hair HI. The partial hair dyeing device 100 according to this embodiment includes, as shown in FIGS. 1A to 5B, the container connector 110 for connection with the dispensing container ST accommodating the hair dye therein, the upper grasp member 120 of a hollow shape formed in a slender shape extending forward from the container connector 110 and including the outlet 121 through which the hair dye is dispensed, the outlet 121 being located in the lower face of the upper grasp member 120, the lower grasp member 130 formed in a slender shape and disposed parallel to the upper grasp member 120 so as to oppose the outlet 121, and the parallel supporting body 140 that displaces at least one of the upper grasp member 120 and the lower grasp member 130 up and downward, while maintaining the upper grasp member 120 and the lower grasp member 130 parallel to each other.

To be more detailed, in the partial hair dyeing device 100 according to this embodiment, a plurality of outlets 121 is formed in two rows on the left and right portion of the lower face of the upper grasp member 120, as shown in FIGS. 4A to 5B. In addition, the partial hair dyeing device 100 according to this embodiment further includes a plurality of hair guide protrusions 122 formed so as to downwardly protrude so as to at least correspond to each interval between the outlets 121 aligned in the upper grasp member 120, the hair guide protrusions 122 being formed in a comb teeth shape as a whole. In other words, the plurality of hair guide protrusions 122 is formed so as to protrude in a comb teeth shape from the lower face of the upper guide member (upper grasp member 120).

Figure 5A:
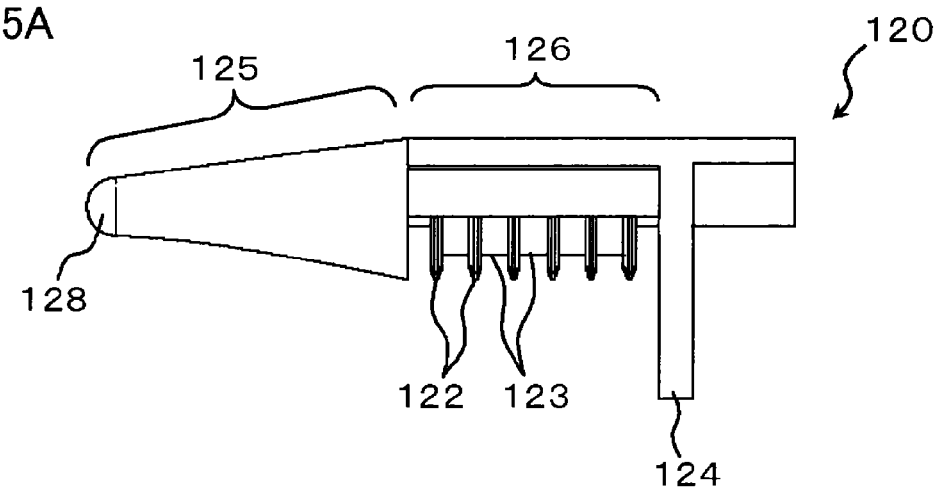
FIG. 5A is a side view.
Figure 5B:
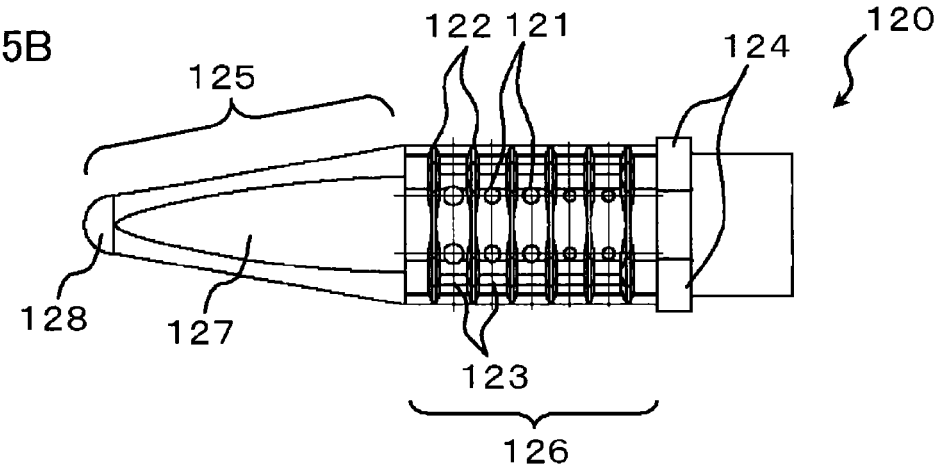
FIG. 5B is a bottom view, respectively showing the upper grasp member.

As shown in FIG. 5B, the outlets 121 are formed such that those located closer to the leading end portion of the upper grasp member 120 have a larger diameter. Such a configuration allows the hair dye having a high viscosity to be uniformly dispensed through the respective outlets 121, despite that the hair dye is supplied from the base portion of the upper grasp member 120 and hence the dispensing pressure drops at positions farther from the base portion. For the sake of clarity of the description, the center line of the outlets 121 aligned in two rows is represented by a fine line in FIG. 5B. As shown therein, the distance between the centers of the adjacent outlets 121 in the respective rows is equal.

Further, as shown in FIGS. 4A to 5B, the upper grasp member 120 includes a hair grasping portion 126 including the plurality of hair guide protrusions 122 formed in the comb teeth shape, and frontal portion 125 formed on the front side of the hair grasping portion 126. In addition, the frontal portion 125 is formed such that the clearance between the upper grasp member 120 and the lower grasp member 130 becomes narrower toward the hair grasping portion 126.

More specifically, the frontal portion 125 of the upper grasp member 120 has a tapered shape in a thicknesswise direction, such that the lower face of the frontal portion 125 is continuously sloped downward from the leading end of the upper grasp member 120 toward the hair grasping portion 126. The lower face of the front end of the hair grasping portion 126 is at the same level as or upper than the lower face of the rear end of the frontal portion 125.

The frontal portion 125 of the upper grasp member 120 has a tapered shape also in a widthwise direction, such that the frontal portion 125 becomes narrower toward the leading end thereof, from the front end of the hair grasping portion 126. A rounded tip 128 of a semispherical shape is formed at the front end of the frontal portion 125.

The frontal portion 125 includes a cylindrical recessed groove 127 formed on the lower side thereof. More specifically, the recessed groove 127 has a shape formed by obliquely cutting a cylinder with respect to its central axis. Thus, nail portions 129 are formed so as to downwardly protrude from the base end portion (opposite the front end) of the frontal portion 125.

The lower end of the hair guide protrusions 122 formed in the hair grasping portion 126 of the upper grasp member 120 are at the same level as or upper than the nail portion 129 located at the lowermost position of the downwardly sloped frontal portion 125. Thus, the hair guide protrusions 122 are flush with the lowermost position of the frontal portion 125, or at an upper level than that.

Figure 3A:
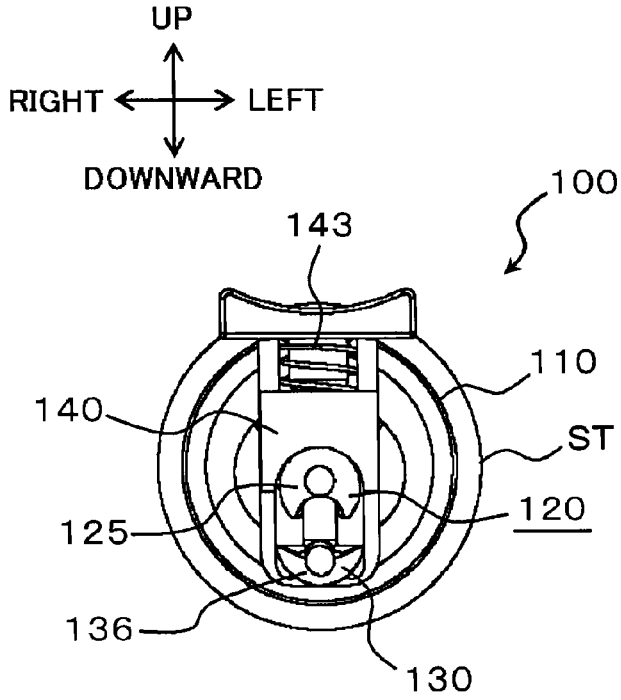
FIGS. 3A and 3B are front views of the partial hair dyeing device, FIG. 3A showing the upper guide member and the lower guide member in the opened state, and FIG. 3B showing the upper grasp member and the lower grasp member in the closed state.

In a front view of the upper grasp member 120 as shown in FIG. 3A, the hair guide protrusions 122 (see FIGS. 4A and 4B) are completely hidden behind the frontal portion 125. In other words, the hair guide protrusions 122 are enclosed in the nail portions 129 (see FIGS. 4A and 4B) of the frontal portion 125 in the front view, and therefore the hair guide protrusion 122 cannot be visually recognized from the front side.

Thus, the lower end of the hair grasping portion 126 of the upper grasp member 120 according to this embodiment is at the same level or upper than the lower end of the frontal portion 125.

Figure 6:
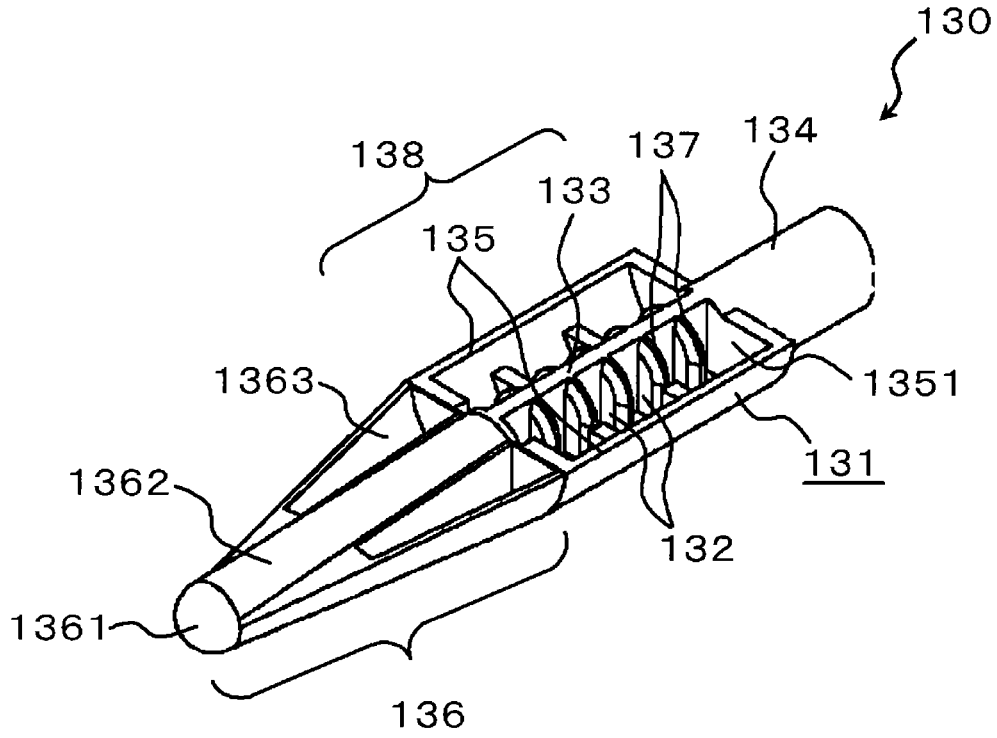
FIG. 6 is a perspective view showing the lower grasp member.
Figure 8A:
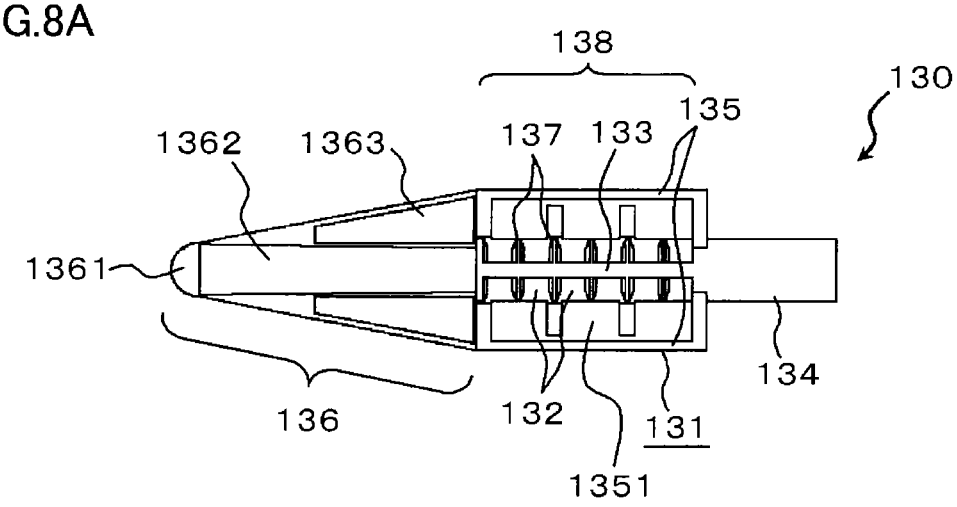
FIG. 8A is a plan view.
Figure 8B:
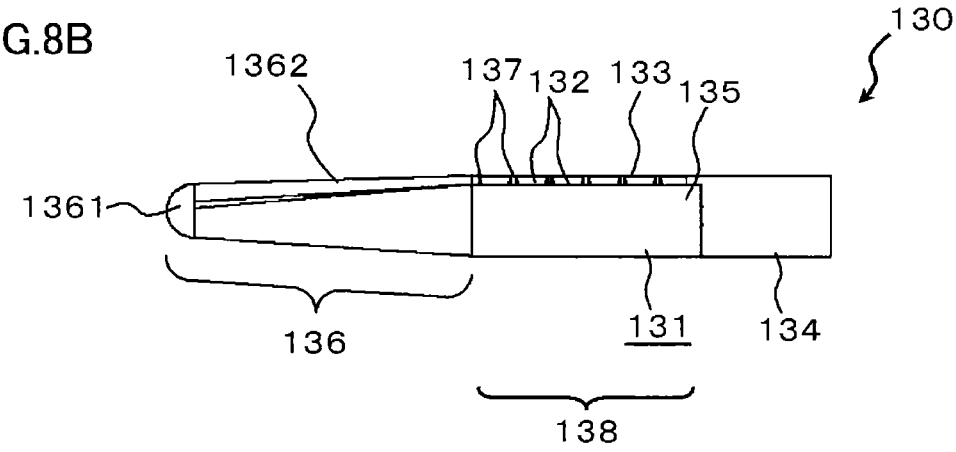
FIG. 8B is a side view, respectively showing the lower grasp member.

Further, as shown in FIGS. 6, 8A, and 8B, the partial hair dyeing device 100 includes a plurality of hair guide recesses 132 formed on the upper face of the lower grasp member 130, in each of which the lower end portion of the corresponding one of the plurality of hair guide protrusions 122 is to be introduced. In the hair guide recess 132, either a part or entirety of the lower portion of the hair guide protrusion 122 may be introduced.

The lower grasp member 130 includes a hair grasping portion 138 including the plurality of hair guide recesses 132 formed thereon and a frontal portion 136 formed on the front side of the hair grasping portion 138. The frontal portion 125 of the upper grasp member 120 and the frontal portion 136 of the lower grasp member 130 can be fitted with each other in a convex-concave pattern.

The hair grasping portion 138 of the lower grasp member 130 is a longitudinal region that serves to grasp the hair on the opposite side of the hair grasping portion 126 of the upper grasp member 120.

The frontal portion 136 of the lower grasp member 130 has a tapered shape such that the frontal portion 136 becomes narrower toward the leading end thereof, from the front end of the hair grasping portion 138. A rounded tip 1361 of a semispherical shape is formed at the front end of the frontal portion 136.

The top portion of the frontal portion 136 of the lower grasp member 130 is formed in a protruding shape, and more specifically in a cylindrical shape. The frontal portion 136 of the lower grasp member 130 according to this embodiment includes a convex portion 1362 protruding in a cylindrical shape and extending in the front-back direction.

As shown in FIG. 8B, the ridgeline of the top portion of the convex portion 1362 is slightly sloped upward from the rounded tip 1361 toward the hair grasping portion 138. Therefore, in an open state shown in FIG. 2A, the clearance between the frontal portion 125 of the upper grasp member 120 and the frontal portion 136 of the lower grasp member 130 is wider at a position closer to the front end.

Since the convex portion 1362 is formed on the upper face of the frontal portion 136 of the lower grasp member 130, the hair HI (see FIG. 7) grasped by the partial hair dyeing device 100 makes a point-contact with the convex portion 1362, on the side of the lower grasp member 130. Such a configuration allows the hair introduced between the rounded tips 128, 1361 to be smoothly conveyed to the hair grasping portions 126, 138.

Figure 3B:
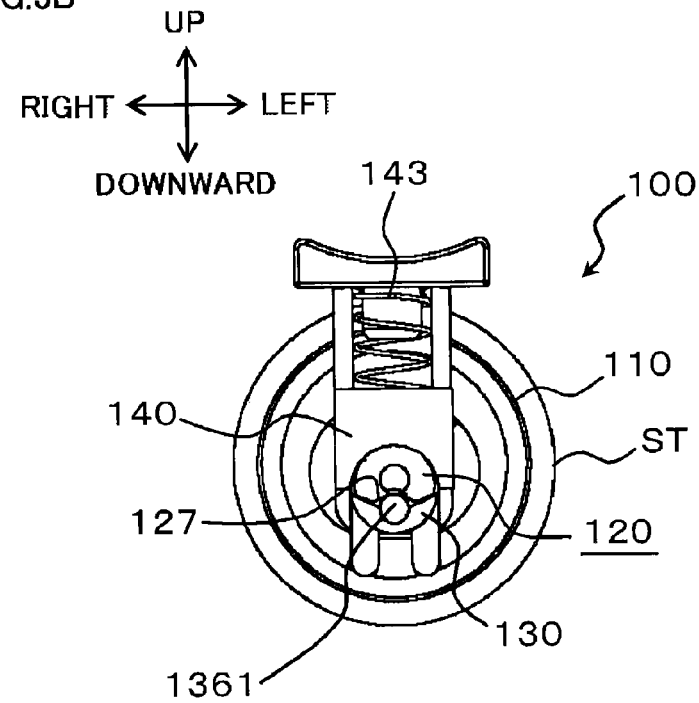
Figure 4A:
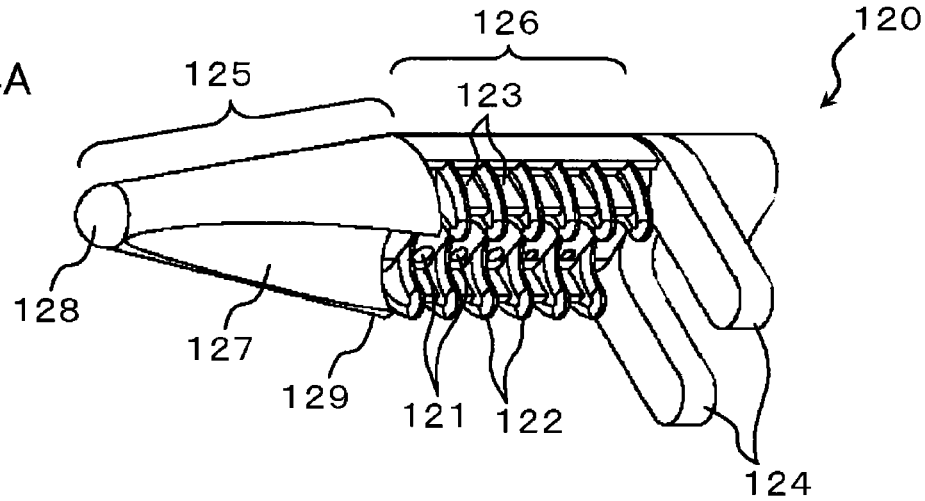
FIGS. 4A and 4B are perspective views of the upper grasp member, FIG. 4A being a lower perspective view from the front, and FIG. 4B being a lower perspective view from the rear.
Figure 4B:
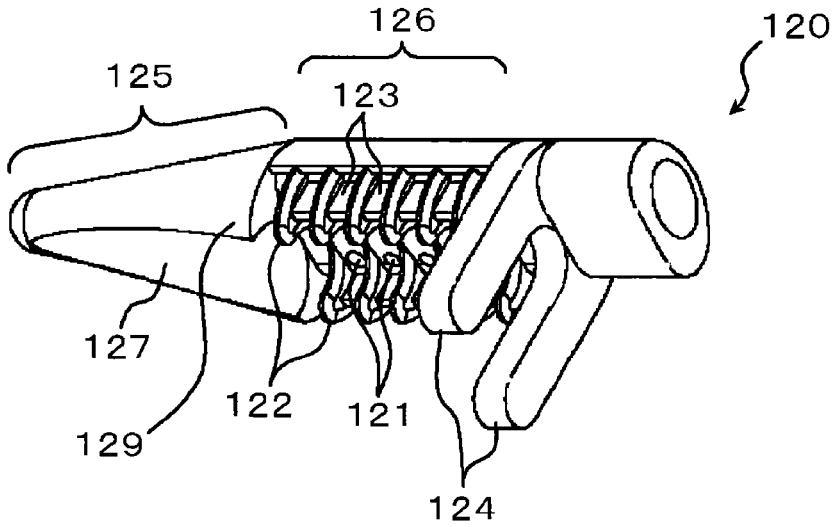

As shown in FIG. 3B, when the upper grasp member 120 and the lower grasp member 130 are closed, the convex portion 1362 of the lower grasp member 130 is fitted with the recessed groove 127 of the upper grasp member 120. In addition, as shown in FIGS. 6, 8A, and 8B, the frontal portion 136 of the lower grasp member 130 includes recesses 1363. The recesses 1363 are formed so as to be fitted with the nail portions 129 of the upper grasp member 120.

Figure 2A:
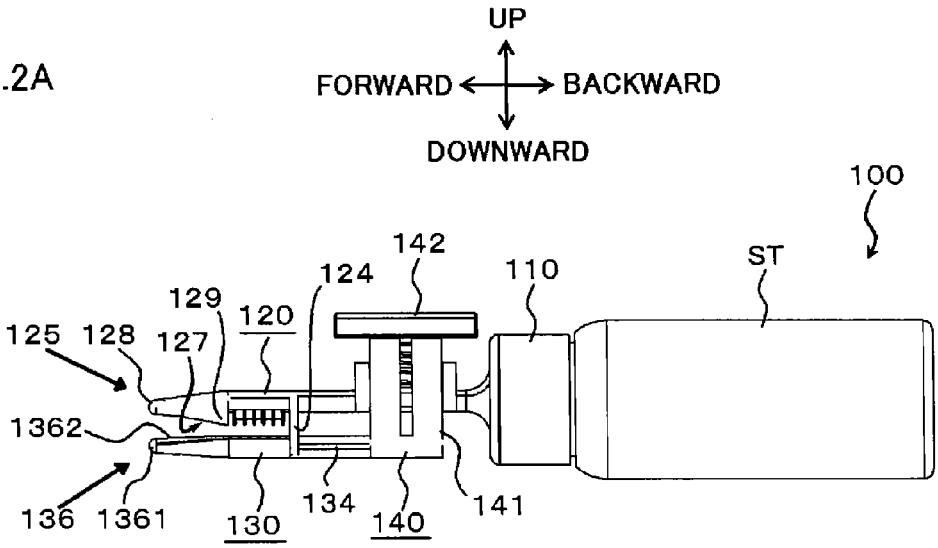
FIGS. 2A and 2B are side views showing the appearance of the partial hair dyeing device, FIG. 2A showing the upper guide member and the lower guide member in the opened state, and FIG. 2B showing the upper grasp member and the lower grasp member in the closed state.

Now, as shown in FIG. 2A, the recessed groove 127 of the upper grasp member 120 is downwardly sloped in the backward direction from the rounded tip 128 toward the nail portion 129, while the convex portion 1362 of the lower grasp member 130 is upwardly sloped in the backward direction.

Accordingly, when the upper grasp member 120 and the lower grasp member 130 move closer to each other, the recessed groove 127 and the convex portion 1362 are gradually fitted with each other from the rear portion toward the front portion. As a result, upon closing the lower grasp member 130 and the upper grasp member 120 with the hair HI (see FIG. 7) introduced therebetween in a layer, a portion of the hair HI located on the front side of the nail portion 129 is gradually squeezed by the recessed groove 127 and the convex portion 1362 so as to move forward. In contrast, another portion of the hair HI deeply introduced so as to reach the hair grasping portions 126, 138 is pinched by the protrusions 122 and hair guide projections 137, without being forced to move forward.

Figure 2B:
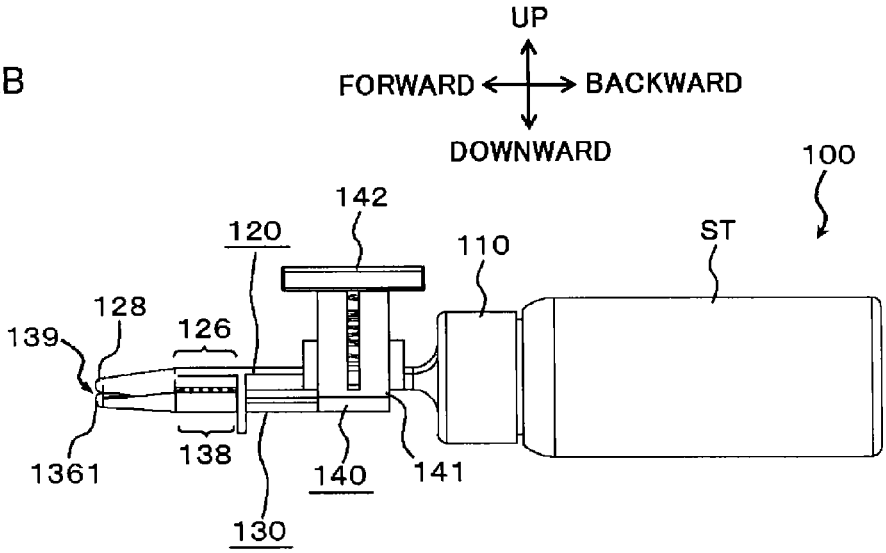

Further, as shown in FIG. 2B, when the upper grasp member 120 and the lower grasp member 130 are closed, the rounded tip 128 of the upper grasp member 120 and the rounded tip 1361 of the lower grasp member 130 are spaced from each other, such that a V-shaped opening 139 is defined at the front end portion of the partial hair dyeing device 100.

Accordingly, the hair HI squeezed forward by the recessed groove 127 and the convex portion 1362 is released from the grasping action of the upper grasp member 120 and the lower grasp member 130, upon reaching the opening 139 at the front end portion of the partial hair dyeing device 100.

As described above, the partial hair dyeing device 100 according to this embodiment allows only the portion of the hair HI for the partial dyeing to remain grasped between the hair grasping portions 126, 138, and the remaining portion of the hair HI to be taken out from the frontal portions 125, 136, simply by closing the upper grasp member 120 and the lower grasp member 130 with the hair HI introduced therebetween.

Therefore, the hair HI can be drawn out in a layer from the head, keeping the upper grasp member 120 and the lower grasp member 130 closed. Then upon dispensing the hair dye to the hair grasping portions 126, 138 with the hair HI grasped between the upper grasp member 120 and the lower grasp member 130, only the hair HI of the desired position can be partially dyed, and the hair dye can be prevented from sticking to the remaining portion of the hair.

As shown in FIG. 8B, the upper edge of the hair guide recess 132 formed in the hair grasping portion 138 of the lower grasp member 130 is at the same level as or lower than the topmost portion of the upwardly sloped convex portion 1362. In other words, the hair guide recess 132 is flush with or lower than the topmost portion of the frontal portion 136.

Further, as shown in FIG. 3A, in a front view of the lower grasp member 130 the hair guide recesses 132 (not shown in FIG. 3A) are completely hidden behind the frontal portion 136. In other words, the hair guide recesses 132 are enclosed in the frontal portion 136 in the front view, and therefore the hair guide recesses 132 cannot be visually recognized from the front side.

In the lower grasp member 130 according to this embodiment, the hair guide recesses 132 correspond to the pitch between adjacent ones of the plurality of hair guide projections 137. In addition, the upper edge of the hair guide projections 137 is at the same level as or lower than the topmost portion of the frontal portion 136 of the lower grasp member 130, as shown in FIG. 8B.

As described above, in this embodiment the lower end of the hair grasping portion 126 of the upper grasp member 120 is located at the same level as or upper than the lower end of the frontal portion 125, and the top portion of the hair grasping portion 138 of the lower grasp member 130 is located at the same level as or lower than the top portion of the frontal portion 136.

In other words, the opposing clearance between the hair grasping portions 126, 138 of the upper grasp member 120 and the lower grasp member 130 is equal to or wider than the opposing clearance between the frontal portions 125, 136.

Accordingly, the hair HI introduced between the frontal portions 125, 136 through between the rounded tips 128, 1361 can be smoothly conveyed through between the hair grasping portions 126, 138 as far as a parallel guide portion 124 (to be subsequently described), maintaining the layer form without being interfered by the hair guide protrusion 122. Therefore, the hair HI held between the hair grasping portions 126, 138 is prevented from gathering in a bundle, and resultantly the hair dye can be uniformly applied to the entirety of the hair HI held between the hair grasping portions 126, 138.

In addition, as shown in FIGS. 4A to 5B, the upper grasp member 120 includes hair guide partitions 123 formed in a rib shape in the clearance between adjacently located hair guide protrusions 122, at positions outer than the respective left and right rows of the outlets 121.

Likewise, as shown in FIGS. 6, 8A, and 8B, the lower grasp member 130 includes at least a row of hair guide wall 133 erected in a rib shape so as to oppose the clearance between the opposing hair guide partitions 123 of the respective left and right rows. More specifically, the lower grasp member 130 includes at least a row of hair guide wall 133 protruded in a rib shape so as to interfere with the clearance between the hair guide partitions 123 of the respective left and right rows.

The hair guide wall 133 is located inside an outer wall 135 of a semicylindrical shape extending in the front-back direction. When the upper grasp member 120 is located at the lower limit position in the parallel supporting body 140, the top edge of the outer wall 135 of the lower grasp member 130 is located at an upper position than lower end of the hair guide partition 123.

In addition, the lower grasp member 130 includes a tail portion 134 formed on the rear side of the hair guide portion 131 including the hair guide recesses 132 and on the front side of the parallel supporting body 140, in a narrower width in the left-right direction than the hair guide portion 131.

The upper grasp member 120 includes, as shown in FIG. 2A, a left and right pair of parallel guide portions 124 each projecting downward so as to hold the tail portion 134 therebetween from the left and the right. Here, in practical use of the partial hair dyeing device 100 the parallel guide portions 124 stick out downward to a position lower than the lower grasp member 130 as shown in FIG. 1A and other related drawings, and thus may contact the user's head (not shown) as will be subsequently described. Accordingly, the lower tip portion of each parallel guide portion 124 is formed in a semicylindrical shape having a central axis parallel to the front-back direction.

In the partial hair dyeing device 100 according to this embodiment, the parallel supporting body 140 has its lower portion fixed to the lower grasp member 130 so as not to relatively move as shown in FIGS. 1A to 3B, and supports the upper grasp member 120 so as to move up and downward.

The parallel supporting body 140 also includes, as shown in FIGS. 3A and 3B, a coil spring 143 that constitutes a biasing mechanism that elastically biases the upper grasp member 120 downward, the coil spring 143 being accommodated inside a retainer casing 141.

As already stated the upper grasp member 120 is integrally formed with the container connector 110 to which the dispensing container ST is connected, and inserted in the box-shaped retainer casing 141 of the parallel supporting body 140, so as to slide up and downward.

The retainer casing 141 includes an opening, for example on the upper face, so as to insert the upper grasp member 120 as above and to place the coil spring 143 therein. However, in the partial hair dyeing device 100 according to this embodiment, the opening in the upper face of the retainer casing 141 is covered, for example, with a finger guide 142 on which the user's finger is to be placed.

In the partial hair dyeing device 100 configured as above according to this embodiment, the dispensing container ST loaded with a hair dye is connected to the container connector 110 from the rear direction.

In this embodiment, the dispensing container ST is exemplified by a squeeze container. The squeeze container herein referred to flexible tubes and bottles loaded with a hair dye, from which the hair dye can be dispensed simply by pressing the container with fingers.

Preferably, a check valve (not shown) may be provided at the outlet of the dispensing container (squeeze container) ST. The check valve prevents oxygen in the air from intruding into the dispensing container ST, thereby prevents oxidation of the hair dye.

In addition, in the case where a small amount of hair dye is left in the dispensing container ST, the check valve prevents the hair dye from spouting with great force by compressed air when the user presses the dispensing container ST.

The partial hair dyeing device 100 according to this embodiment may be sold as a product including the dispensing container ST attached thereto, or as an independent product to which a separately sold dispensing container ST can be attached.

The upper grasp member 120, which has a hollow slender shape and extends forward from the container connector 110 to which the dispensing container ST is connected, dispenses the hair dye through the plurality of outlets 121 formed in the lower face of the upper grasp member 120 at least in left and right two rows.

The lower grasp member 130 has a slender shape and is disposed parallel to the upper grasp member 120 so as to oppose the outlets 121. As shown in FIGS. 1A to 3B, at least one of the upper grasp member 120 and the lower grasp member 130 is displaced up and downward, with the both grasp members being maintained parallel to each other. By such an action, the hair HI to be partially dyed can be selectively caught in a layer, with the upper grasp member 120 and the lower grasp member 130 parallelly spaced from each other as shown in FIG. 1A and other related drawings.

More specifically, upon sliding the lower grasp member 130 along the scalp, the hair HI aligned in the sliding direction can be introduced in a layer between the upper grasp member 120 and the lower grasp member 130, in a layer thickness corresponding to the clearance (opening width) between the frontal portions 125, 136 of the upper grasp member 120 and the lower grasp member 130. In this process, since the upper grasp member 120 and the lower grasp member 130 have the tapered shape, the hair HI to be partially dyed can be selectively caught easily, in a layer.

Upon selectively catching the hair HI to be partially dyed with the upper grasp member 120 and the lower grasp member 130 parallelly spaced from each other as described above, the coil spring 143 causes the lower grasp member 130 to elastically contact the upper grasp member 120 as shown in FIG. 3B and other related drawings.

Such a configuration eliminates the need to keep the upper grasp member 120 and the lower grasp member 130 closed by manual operation, and allows the upper grasp member 120 and the lower grasp member 130 to grasp the hair HI with an appropriate pressure.

Upon pressing the dispensing container ST in the aforementioned state, the hair dye is dispensed through the outlets 121 of the upper grasp member 120, and the base portion of the grasped hair HI can be partial dyed.

Then by moving the partial hair dyeing device 100 to the tip portion of the hair HI keeping the dispensing container ST pressed, an individual user can maintain the hair HI in a uniform layer so as to dye the hair HI from the base portion to the tip portion thereof.

In addition, the upper grasp member 120 includes the hair guide partitions 123 formed in a rib shape between adjacently located hair guide protrusions 122, at positions outer than the respective left and right rows of the outlets 121, as shown in FIGS. 4A to 5B. Therefore, the hair dye dispensed through the outlets 121 and applied to the hair HI can be properly leveled off by the hair guide partitions 123.

Further, as shown in FIGS. 6, 8A, and 8B, the lower grasp member 130 includes a row of hair guide wall 133 erected in a rib shape so as to interfere with the clearance between the hair guide partitions 123 of the respective left and right rows. Accordingly, the layer of hair HI grasped between the upper grasp member 120 and the lower grasp member 130 is retained in a W-letter shape by the hair guide partitions 123 on the respective sides and the hair guide wall 133 at the center as shown in FIG. 7, and disposed so as to oppose the respective rows of outlets 121.

Figure 7:
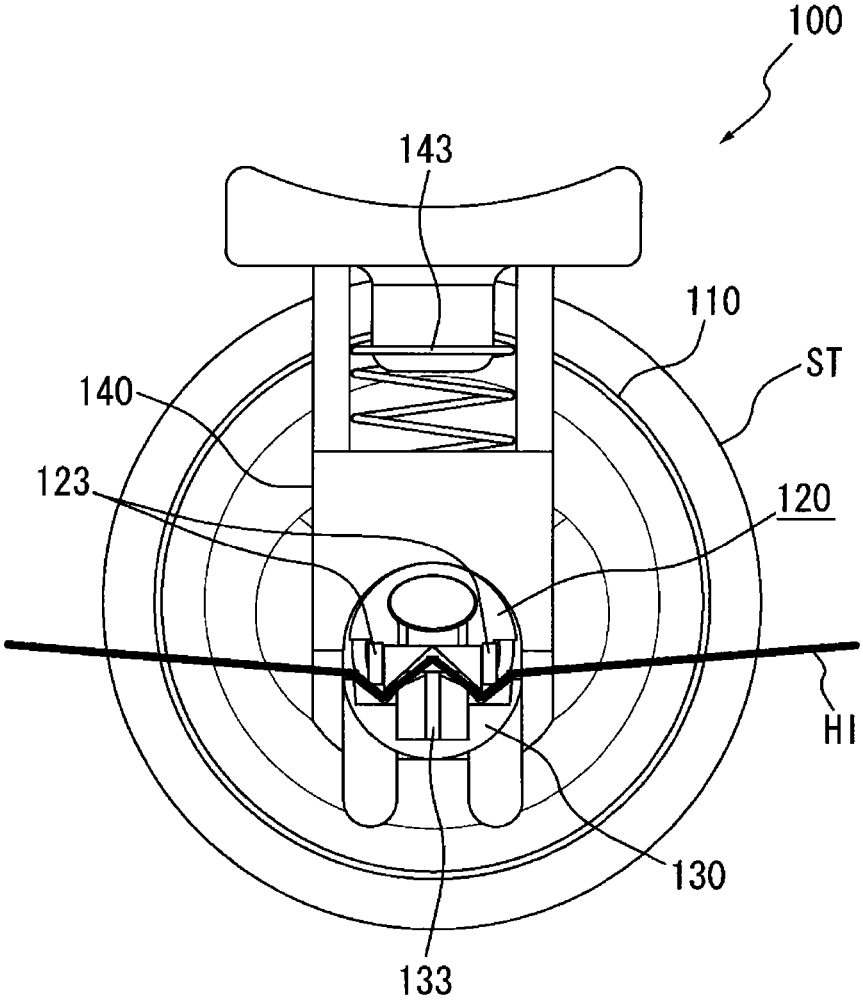
FIG. 7 is a schematic cross-sectional front view showing a state where hair is retained in a W-letter shape by the upper grasp member and the lower grasp member.

Upon sliding the partial hair dyeing device 100 toward the tip portion of the hair HI with the hair HI thus grasped, the layer of hair HI passes between the upper grasp member 120 and the lower grasp member 130, waving in the W-letter shape as shown in FIG. 7 and making contact with the hair dye.

Such an arrangement assures that the layer of hair HI grasped between the upper grasp member 120 and the lower grasp member 130 is disposed close to the two rows of outlets 121, so as to be effectively dyed from the base portion of the hair HI. In addition, the hair guide partitions 123 and the hair guide wall 133 serve to stroke the layer of hair HI passing therebetween, to thereby urge the hair dye to penetrate inward.

In particular, since the hair guide partitions 123 and the hair guide wall 133 according to this embodiment are projecting in opposite directions in the up-down direction, the hair dye can be made to penetrate in the layer of hair HI from both upper and lower directions, so that the hair HI can be uniformly dyed, free from spots.

Now, as shown in FIGS. 4A to 5B, the upper grasp member 120 includes the plurality of hair guide protrusions 122 formed on the lower face thereof, in a comb teeth shape as a whole. Accordingly, the hair HI caught in a layer is divided by the hair guide protrusions 122 into a plurality of groups aligned in the front-back direction, when grasped by the hair grasping portions 126, 138.

To be more detailed, as shown in FIGS. 6, 8A, and 8B, the lower end portion of each of the plurality of hair guide protrusions 122 intrudes into the corresponding one of the plurality of hair guide recesses 132 formed on the upper face of the lower grasp member 130. Such a configuration assures that the hair HI caught in a layer as above is retained in the form of the plurality of groups divided as above.

Therefore, the hair HI grasped in a layer is prevented from moving back and forth so as to gather in a bundle, while moving the partial hair dyeing device 100 in the left-right direction from the base portion to the tip portion of the hair HI so as to apply the hair dye thereto. This further assures that the hair dye can be uniformly applied to the hair HI.

When the upper grasp member 120 and the lower grasp member 130 are spaced from each other in parallel, the pair of parallel guide portions 124 of the upper grasp member 120 does not stick out from the lower end of the lower grasp member 130.

Therefore, the parallel guide portions 124 are kept from colliding with the head, which allows the hair HI for partial dyeing to be selectively caught from the base portion thereof without difficulty, by the parallelly spaced upper grasp member 120 and lower grasp member 130.

Further, the layer of hair HI grasped between the upper grasp member 120 and the lower grasp member 130 contacts the outer wall 135 upon passing over the lower grasp member 130 in the left-right direction. Accordingly, an excessive amount of hair dye applied to the hair HI is scraped off by the outer wall 135, and deposited in a liquid reservoir 1351 (see FIGS. 6, 8A and 8B). Such a configuration allows the hair dye to be uniformly applied to the entirety of the hair HI passing over the liquid reservoir 1351.

In the partial hair dyeing device 100 according to this embodiment, as shown in FIGS. 6 to 8B, the lower grasp member 130 includes the tail portion 134 formed on the rear side of the hair guide portion 131 including the hair guide recesses 132 and on the front side of the parallel supporting body 140, in a narrower width in the left-right direction than the hair guide portion 131.

In addition, as shown in FIGS. 4A to 5B, the upper grasp member 120 includes the pair of parallel guide portions 124 each projecting downward so as to hold the tail portion 134 of the lower grasp member 130 therebetween from the left and the right.

Figure 1B:
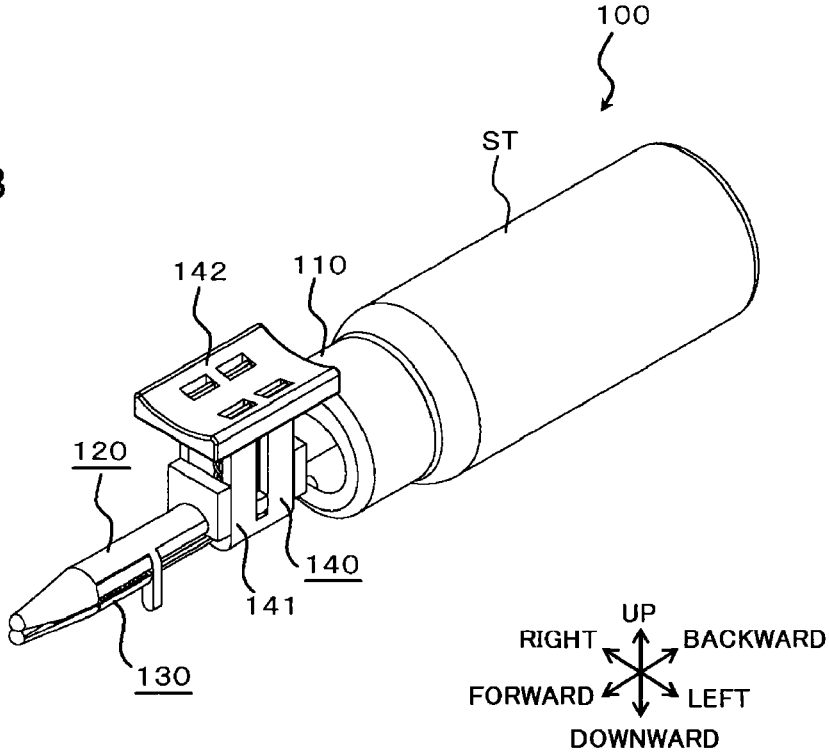

Therefore, as shown in FIG. 1B and other related drawings, the parallel guide portions 124 serve to delimit the position of the hair HI to be introduced in a layer into the clearance between the upper grasp member 120 and the lower grasp member 130.

In the partial hair dyeing device 100 according to this embodiment, further, the parallel supporting body 140 has its lower portion fixed to the lower grasp member 130 and supports the upper grasp member 120 so as to move up and downward, as shown in FIG. 1A and other related drawings. Such a configuration allows the hair HI to be easily caught from the base portion thereof between the upper grasp member 120 and the lower grasp member 130, for performing the partial dyeing.

Since the dispensing container ST is connected to the upper grasp member 120, the dispensing container ST is located in a position farther away from the head, than in the case where the dispensing container ST is connected to the lower grasp member 130.

Such a configuration effectively prevents the dispensing container ST from interfering with the head, thereby facilitating the base portion of the hair HI for the partial dyeing to be freely caught by the upper grasp member 120 and the lower grasp member 130.

The upper grasp member 120 and the lower grasp member 130 are made to elastically grasp the hair HI by the coil spring 143 placed inside the parallel supporting body 140. Therefore, the layer of hair HI can be grasped with an appropriate pressure for performing the partial dyeing, which exempts the user from the trouble of manually adjusting the grasping force.

It is to be understood that the present invention is in no way limited to the foregoing embodiment, but various modifications may be made within the scope and spirit of the present invention. For example, although the dispensing container ST is connected to the upper grasp member 120 according to the embodiment, the dispensing container ST may be connected to the lower grasp member 130. In this case, naturally, the lower grasp member 130 is formed in a hollow shape with the outlets formed in the upper face thereof (not shown).

According to the embodiment, the plurality of hair guide protrusions 122 is formed so as to downwardly protrude at positions corresponding to each interval between the outlets 121 aligned in the upper grasp member 120 as shown in FIGS. 4A to 5B, and, each of the plurality of hair guide protrusions 122 intrudes into the corresponding one of the plurality of hair guide recesses 132 formed on the upper face of the lower grasp member 130, as shown in FIGS. 6, 8A, and 8B.

However, the hair guide recess 132 may be formed as a clearance between projecting members (hair guide projections 137) as in the embodiment, or formed of a recessed member. In other words, the lower grasp member 130 may include a plurality of hair guide recesses formed on the upper face thereof at positions respectively corresponding to the plurality of hair guide protrusions aligned on the upper grasp member.

Further, according to the embodiment, the left and right two rows of outlets 121 in the hair grasping portion 126 of the upper grasp member 120 are formed in a circular shape. However, the outlets may be formed in an oval shape, or in a single continuous slit in the upper grasp member 120. In the case of forming the outlet as a slit, it is preferable to gradually increase the width toward the forward direction, so that a hair dye having a high viscosity can be evenly dispensed throughout the hair grasping portion 126.

In addition, the outlets 121 may be formed in three or more rows instead of two rows in the lower face of the upper grasp member 120, so as to properly dispense a hair dye having a high viscosity. Conversely, in the case where the hair dye has a low viscosity, the outlet may be formed in a single line.

Further, according to the embodiment an outlet 121 is formed in each clearance between the hair guide protrusions 122. However, a plurality of outlets 121 may be formed between the hair guide protrusions 122.

Likewise, according to the embodiment the hair guide partitions 123 are formed in a rib shape between the hair guide protrusions 122 on the respective sides of the upper grasp member 120, and one row of hair guide wall 133 is formed on the lower grasp member 130 in a rib shape so as to interfere with the clearance between the left and right rows of the hair guide partitions 123.

However, the lower grasp member may include left and right two rows of hair guide walls formed in such a shape that opposes the respective rows of hair guide partitions on the upper grasp member (not shown). Such a configuration allows hair HI that is more difficult to be combed than straight hair, for example kinky hair or wavy hair, to be easily passed through the clearance between the upper grasp member 120 and the lower grasp member 130.

Figure 9:
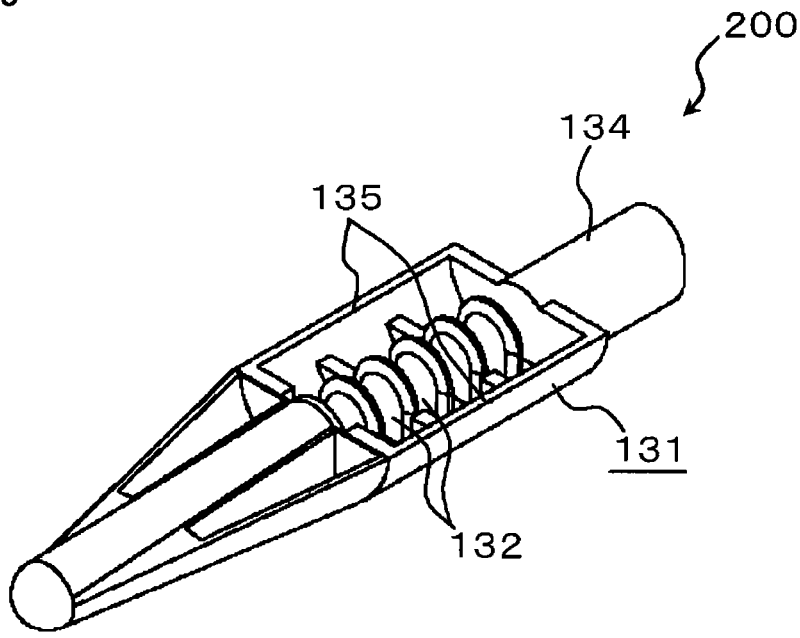
FIG. 9 is a perspective view showing an appearance of a lower grasp member of the partial hair dyeing device according to a variation of the embodiment.
Figure 10A:
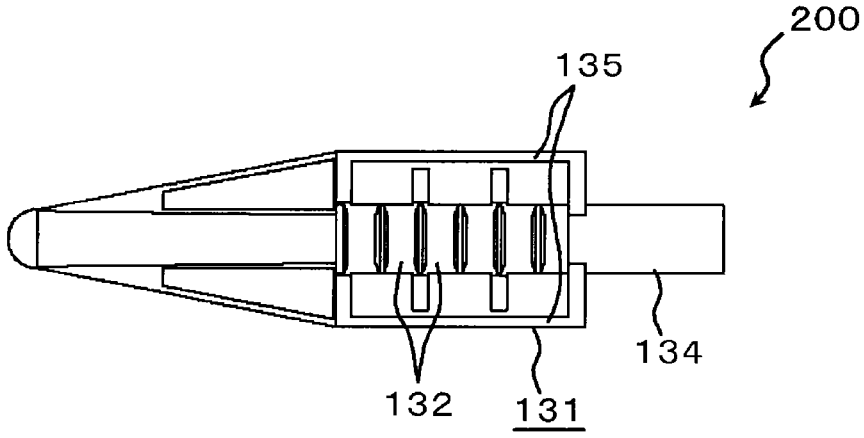
FIG. 10A is a plan view.
Figure 10B:
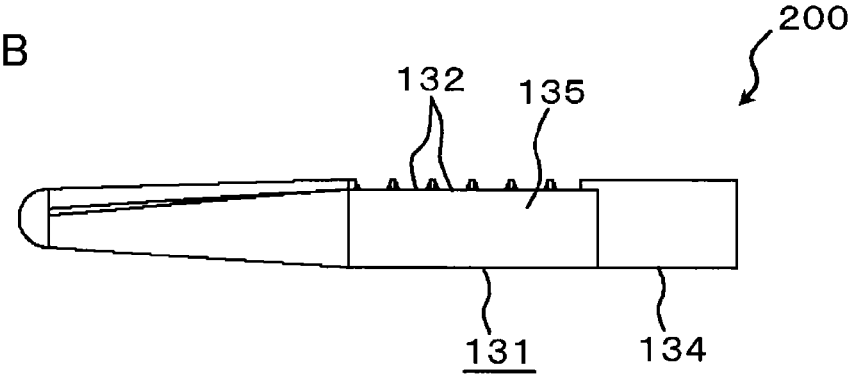
FIG. 10B is a side view, respectively showing the lower grasp member according to the variation of the embodiment.

Likewise, according to the embodiment a row of hair guide wall 133 is formed so as to project in a rib shape at the center of the lower grasp member 130, as shown in FIGS. 6 to 8B. However, the hair guide wall 133 may be unformed, as in a lower grasp member 200 shown in FIGS. 9 to 10B.

Such a configuration allows hair HI that is more difficult to be combed than straight hair, for example kinky hair or wavy hair, to be easily passed through the clearance between the upper grasp member 120 and the lower grasp member 200. Alternatively, reducing the height of the hair guide partitions 123 on the upper grasp member 120, or removing the hair guide partitions 123 facilitates kinky hair or wavy hair to be passed through between the upper and lower grasp members.

Further, according to the embodiment the left and right pair of parallel guide portions 124 projecting downward from the upper grasp member 120 holds the tail portion 134 of the lower grasp member 130 therebetween from the left and the right.

Instead, a pair of parallel guide portions of a similar shape may be formed so as to project upward from the lower grasp member 130, and so as to hold the narrow rear portion of the upper grasp member 120 therebetween from the left and the right. However, it is preferable that the upper grasp member 120 is wider than the lower grasp member 130 since the upper grasp member 120 has to be formed in a hollow shape in a certain width for transporting the hair dye therethrough. Accordingly, forming the parallel guide portions 124 on the upper grasp member 120 so as to hold the lower grasp member 130 therebetween from the left and the right as the foregoing embodiment is more advantageous. Such a configuration allows the parallel guide portions 124 to be made narrower, thereby preventing the parallel guide portions 124 from interfering with the action of introducing the hair HI between the upper and lower grasp members.

Furthermore, according to the embodiment the left and right pair of parallel guide portions 124 is a fixed structure projecting downward from the upper grasp member 120.

However, the parallel guide portions may be attached to the upper grasp member so as to move back and forth (not shown).

In this case, the width of the layer of hair HI passed through the clearance between the upper grasp member 120 and the lower grasp member 130 can be adjusted by shifting the position of the parallel guide portion, and therefore an individual user can easily adjust the width of the hair HI to be partially dyed.

Furthermore, according to the embodiment the parallel supporting body 140 serves to move the upper grasp member 120 relatively upward from the lower grasp member 130 parallel thereto to a predetermined position, so as to allow the hair HI to pass through the clearance in a layer.

The parallel supporting body thus configured may be given a function to vary the clearance between the upper grasp member 120 and the lower grasp member 130. For example, a stopper (not shown) that delimits the uppermost position of the finger guide 142 with respect to the retainer casing 141 may be provided such that the position of the stopper is variable, so as to adjust the maximal clearance between the upper grasp member 120 and the lower grasp member 130 depending on the position of the stopper. In this case, the thickness of the layer of hair HI to be passed between the upper grasp member 120 and the lower grasp member 130 becomes variable, which facilitates an individual user to adjust the thickness of the layer of hair HI to be partially dyed.

Still further, according to the embodiment the dispensing container is exemplified by a single-layer squeeze container. However, a double-layer squeeze container may be employed, as described in Japanese Laid-Open Patent No. H4-189781 and Japanese Laid-Open Patent No. H10-165222, for example. Employing the double-layer container allows the outer container to be reused by replacing only the inner container loaded with a hair dye.

Another example of the squeeze container that can be employed as the dispensing container can be found in Japanese Laid-Open Patent No. 2000-16470, which is composed of a flexible outer layer and an inner layer removably attached to the outer layer, the outer layer including an air inlet and the inner layer including an outlet communicating with the air inlet. Such a container allows the hair dye to be dispensed in any orientation of the container, and prevents the hair dye from splashing because of air being mixed therein, despite that the amount of the remaining hair dye has decreased.

Still further, a container other than squeeze containers may be employed as the dispensing container. For example, a double-layer container according to Japanese Laid-Open Patent No. H9-295674 may be employed, which includes an outer cylinder formed in a cylindrical shape, an inner bag accommodated in the outer cylinder and having an opening unified with that of the outer cylinder, and a bottom lid rotatably fixed to an end portion of the outer cylinder opposite the opening thereof. In addition, a pump-operated liquid dispensing container according to Japanese Laid-Open Patent No. H9-193958 may be employed, which includes a sliding plate located in a lower portion of the container body so as to be elevated by a decrease in amount of the liquid in the container body.

It is a matter of course that the foregoing embodiment and the plurality of variations thereof may be combined unless a conflict of effects is incurred. In addition, although the configurations of the constituents have been specifically described regarding the embodiment and variations, such configurations may be modified in various manners within the scope of the present invention. For example, although the upper guide member and the lower guide member of the applicator according to the embodiment are formed so as to project straight ahead from the container connector 110, the present invention is not limited to such a configuration. The hair grasping portion of either the upper guide member or lower guide member including the outlets 121 for dispensing the treatment agent may be bent in an L-letter shape or curved in an arcuate shape in the left-right direction indicated in FIGS. 1A and 1B, with respect to the base portion connected to the container connector 110 for supplying the treatment agent. In this case, in the description of such an applicator, the left-right direction with respect to the upper grasp member 120 and the lower grasp member 130 does not necessarily agree with the left-right direction with respect to the container connector 110. More specifically, the left-right direction with respect to the upper guide member (upper grasp member 120) and the lower guide member (lower grasp member 130) is orthogonal to both the direction in which these members extend (front-back direction) and the direction in which the parallel supporting body 140 moves (up-down direction). On the other hand, the left-right direction with respect to the container connector 110 is orthogonal to both the direction in which the treatment agent dispensed from the dispensing container ST passes through the container connector 110 (front-back direction), and the up-down direction mentioned above.

This embodiment encompasses the following technical ideas.

(1) A partial hair dyeing device to be used for partially dyeing one's head hair, including a container connector for connection with a dispensing container accommodating hair dye therein; an upper grasp member of a hollow shape formed in a slender shape extending forward from the container connector, and including an outlet through which the hair dye is dispensed, the outlet being located on a lower face of the upper grasp member; a lower grasp member formed in a slender shape and disposed parallel to the upper grasp member so as to oppose the outlet; and a parallel supporting body that displaces at least one of the upper grasp member and the lower grasp member up and downward, while maintaining the upper grasp member and the lower grasp member parallel to each other;

(2) The partial hair dyeing device according to (1) above, further including a plurality of hair guide protrusions formed so as to protrude from a lower face of the upper grasp member, in a comb teeth shape as a whole;

(3) The partial hair dyeing device according to (2) above, in which the upper grasp member includes a hair grasping portion including a plurality of the hair guide protrusions formed in a comb teeth shape and a frontal portion formed on a front side of the hair grasping portion, and the frontal portion is formed such that a clearance between the upper grasp member and the lower grasp member becomes narrower from a forward position toward the hair grasping portion;

(4) The partial hair dyeing device according to (3) above, in which a lower end of the hair grasping portion in the upper grasp member is located upper than a lower end of the frontal portion in the upper grasp member;

(5) The partial hair dyeing device according to any one of (2) to (4) above, further including a plurality of hair guide recesses formed on an upper face of the lower grasp member and each opposing a corresponding one of the plurality of hair guide protrusions;

(6) The partial hair dyeing device according to any one of (2) to (4) above, further including a plurality of hair guide recesses formed on an upper face of the lower grasp member, in each of the hair guide recesses at least a lower end portion of a corresponding one of the plurality of hair guide protrusions is to be introduced;

(7) The partial hair dyeing device according to (6) above, in which the lower grasp member includes a hair grasping portion including the plurality of hair guide recesses and a frontal portion formed on a front side of the hair grasping portion, and the frontal portion of the upper grasp member and that of the lower grasp member are fitted with each other in a convex-concave pattern;

(8) The partial hair dyeing device according to (6) or (7) above, in which each of the plurality of hair guide recesses is formed in a clearance between the plurality of hair guide projections, and an upper end of the hair guide projection is located lower than an upper end of the frontal portion;

(9) The partial hair dyeing device according to any one of (2) to (8) above, in which the upper grasp member includes a plurality of hair guide partitions each formed in a rib shape in a clearance between the plurality of hair guide protrusions, at positions outer than the respective left and right rows of the outlets;

(10) The partial hair dyeing device according to (9) above, in which the lower grasp member includes at least a row of hair guide wall erected in a rib shape so as to oppose a clearance between the hair guide partitions of the respective left and right rows;

(11) The partial hair dyeing device according to (9) above, in which the lower grasp member includes at least a row of hair guide wall protruded in a rib shape so as to be introduced in a clearance between the hair guide partitions of the respective left and right rows;

(12) The partial hair dyeing device according to any one of (6) to (11) above, in which the lower grasp member includes a tail portion formed on a rear side of the hair guide portion including the hair guide recesses and on a front side of the parallel supporting body, in a narrower width in a left-right direction, and the upper grasp member includes a left and right pair of parallel guide portions projecting downward so as to hold the tail portion therebetween from a left and right direction;

(13) The partial hair dyeing device according to (12) above, in which the upper grasp member supports the parallel guide portions so as to move back and forth;

(14) The partial hair dyeing device according to any one of (1) to (13) above, in which the parallel supporting body has a lower portion thereof fixed to the lower grasp member and supports the upper grasp member so as to move up and downward;

(15) The partial hair dyeing device according to (14) above, in which the parallel supporting body includes therein a biasing mechanism that elastically biases the upper grasp member downward;

(16) The partial hair dyeing device according to any one of (1) to (15) above, in which the parallel supporting body is configured so as to set the clearance between the lower grasp member and the upper grasp member in a variable manner; and

(17) The partial hair dyeing device according to any one of (1) to (17) above, in which a tip portion of the upper grasp member and that of the lower grasp member are formed in a semispherical shape.

This application claims priority based on Japanese Patent Application No. 2009-257805 filed on Nov. 11, 2009, the entire content of which is incorporated hereinto.

The invention claimed is:

1. An applicator to apply a treatment agent to head hair, the applicator comprising:

a container connector to connect with a dispensing container having a treatment agent present therein;

an upper guide member of a hollow shape comprising an outlet formed in a lower face thereof through which the treatment agent is dispensed, the upper guide member formed so as to extend in a forward direction away from the container connector;

a lower guide member disposed parallel to the upper guide member, the lower guide member including an upper face that opposes the outlet;

a parallel supporting body to displace at least one of the upper guide member and the lower guide member along upward and downward directions while maintaining the upper guide member and the lower guide member parallel to each other, wherein the upper guide member comprises a hair grasping portion and a frontal portion formed in front of the hair grasping portion with respect to the forward direction, the hair grasping portion of the upper guide member comprises a plurality of hair guide protrusions present on the lower face, and protruding in a comb teeth shape, and the frontal portion of the upper guide member forms at least an end of the upper guide member in the forward direction that is distal to the container connector, and is formed such that a clearance between the upper guide member and the lower guide member decreases from the end of the upper guide member toward the hair grasping portion; and a plurality of hair guide recesses formed on the upper face of the lower guide member to receive the hair guide protrusions, wherein the lower guide member comprises a hair grasping portion comprising the hair guide recesses and a frontal portion formed in front of the hair grasping portion, with respect to the forward direction, and the frontal portion of the upper guide member and the frontal portion of the lower guide member fit with each other in a convex-concave pattern.

2. The applicator according to claim 1, wherein the frontal portion of the upper guide member extends, in the downward direction, beyond the hair grasping portion.

3. The applicator according to claim 1, wherein each of the plurality of hair guide recesses formed on the upper face of the lower guide member oppose a corresponding one of the plurality of hair guide protrusions.

4. The applicator according to claim 1, wherein the plurality of hair guide recesses formed on the upper face of the lower guide member are to receive the of hair guide protrusions.

5. The applicator according to claim 1, wherein ones of the hair guide recesses are located so as to correspond to a clearance between adjacently located ones of hair guide projections, and an upper end of the hair guide projections is located lower than an upper end of the frontal portion of the lower guide member.

6. The applicator according to claim 1, wherein the upper guide member comprises a hair guide partition, the hair guide partition including left and right ribs that extend in the forward direction on left and right sides of the outlet and in a clearance between adjacently located ones of the plurality of the hair guide protrusions.

7. The applicator according to claim 6, wherein the lower guide member comprises at least one hair guide wall erected in a rib shape so as to oppose a clearance between the left and right ribs of the hair guide partition.

8. The applicator according to claim 6, wherein the lower guide member comprises at least one hair guide wall protruded in a rib shape so as to be introduced in a clearance between the left and right ribs of the hair guide partition.

9. The applicator according to claim 1, wherein:

the lower guide member comprises a tail portion formed behind the hair guide recesses, with respect to the forward direction, and in front of the parallel supporting body, with respect to the forward direction, the tail portion having a narrower width in a left-right direction than a hair guide portion of the lower guide member that includes the hair guide recesses, and the upper guide member comprises a pair of parallel guide portions projecting toward the lower guide member so as to guide the tail portion therebetween.

10. The applicator according to claim 9, wherein the upper guide member supports the parallel guide portions so as to move back and forth in the forward direction.

11. The applicator according to claim 1, wherein the parallel supporting body has a lower portion thereof fixed to the lower guide member and supports the upper guide member so as to move in the upward and downward directions.

12. The applicator according to claim 11, wherein the parallel supporting body comprises a biasing mechanism that elastically biases the upper guide member towards the lower guide member.

13. The applicator according to claim 1, wherein the parallel supporting body is to set a clearance between the lower guide member and the upper guide member in a variable manner.

14. The applicator according to claim 1, wherein a tip portion of the upper guide member and a tip portion of the lower guide member are in the form of a semispherical shape.

15. A partial hair dyeing device to partially dye head hair, the device comprising:

a container connector to connect with a dispensing container having hair dye therein present therein;

an upper grasp member of a hollow shape formed in a slender shape extending in a forward direction from the container connector, and comprising an outlet through which the hair dye is to be dispensed, the outlet being located on a lower face of the upper grasp member;

a lower grasp member formed in a slender shape and disposed parallel to the upper grasp member, the lower grasp member including an upper face that opposes the outlet;

a parallel supporting body that displaces at least one of the upper grasp member and the lower grasp member along upward and downward directions while maintaining the upper grasp member and the lower grasp member parallel to each other, wherein the upper grasp member comprises a hair grasping portion and a frontal portion formed in front of the hair grasping portion with respect to the forward direction, the hair grasping portion of the upper grasp member comprises a plurality of hair guide protrusions protruding from the lower face of the upper grasp member in a comb teeth shape, and the frontal portion of the upper grasp member forms at least an end of the upper grasp member in the forward direction that is distal to the container connector, and is formed such that a clearance between the upper grasp member and the lower grasp member decreases from the end of the upper grasp member toward the hair grasping portion; and a plurality of hair guide recesses formed on the upper face of the lower grasp member to receive the hair guide protrusions, wherein the lower grasp member comprises a hair grasping portion comprising the hair guide recesses and a frontal portion formed in front of the hair grasping portion, with respect to the forward direction, and the frontal portion of the upper grasp member and the frontal portion of the lower grasp member fit with each other in a convex-concave pattern.

* * * * *